United States Patent [19]

Viannay et al.

[11] Patent Number: 4,813,652

[45] Date of Patent: Mar. 21, 1989

[54] PLANT FOR EFFECTING THE CONTROLLED COOLING OF METAL SHEETS

[75] Inventors: Stéphane Viannay, Voisin le Bretonneux; Jack Sebbah, Trith Saint Leger, both of France

[73] Assignee: Union Siderurgique du Nord et de l'est de la France (Usinor), Puteaux, France

[21] Appl. No.: 72,524

[22] Filed: Jul. 13, 1987

Related U.S. Application Data

[62] Division of Ser. No. 839,828, Mar. 13, 1986, Pat. No. 4,720,310.

[51] Int. Cl.[4] ..... C21D 11/00

[52] U.S. Cl. ..... 266/80; 266/87; 266/89; 266/90; 266/112; 266/259

[58] Field of Search ..... 266/78, 80, 87, 88, 266/89, 90, 112, 114, 117, 130, 131, 133

[56] References Cited

U.S. PATENT DOCUMENTS

| | | | |
|---|---|---|---|
| 3,792,844 | 2/1974 | Berry et al. | 266/114 |
| 3,885,581 | 8/1975 | Dahan | 134/122 |
| 3,990,257 | 11/1976 | Taylor et al. | 62/63 |
| 3,993,086 | 11/1976 | Nellen et al. | 134/57 R |
| 4,440,583 | 4/1984 | Ikegami et al. | 148/128 |

FOREIGN PATENT DOCUMENTS 770586 10/1980 U.S.S.R. .

*Primary Examiner*—Christopher W. Brody
*Attorney, Agent, or Firm*—Cushman, Darby & Cushman

[57] ABSTRACT

The process controls the cooling of a metal sheet so as to impart thereto a predetermined crystalline structure. The sheet to be cooled is passed through a case containing a mass of regularly renewed cooling fluid. The flow of the cooling fluid is controlled as a function of the inlet temperature of this fluid, in accordance with the thickness of the sheet to be cooled and the desired cooling rate.

8 Claims, 2 Drawing Sheets

3
29
54
55
32
34
35
36
39
40
41
42
43
44
45
46
47
50
51
52
53
30
33
37
38
$A_1$
$A_2$
$A_3$
V
q
P
C
S
$\theta > \theta_f + \Delta\theta$
$\theta < \theta_f - \Delta\theta$
$\theta_f + \Delta\theta$
$\theta_f = q\theta + p$
$P > P_1$
$P_0 + \varepsilon = P_1$
$I_1$
$I_2$
$I_3$
$I_4$
$I_5$
$I_6$
$I_8$
$I_9$
$I_{10}$
$+V_0$
$+U_0$
$-U_0$
$+\Delta\theta$
$-\Delta\theta$
E

PLANT FOR EFFECTING THE CONTROLLED COOLING OF METAL SHEETS

This is a division of application Ser. No. 839,828, filed Mar. 13, 1986 now U.S. Pat. No. 4,720,310.

The present invention relates to a process for effecting the controlled cooling of metal sheets for the purpose of obtaining a perfectly defined crystalline structure of the metal of the sheet.

It also relates to a plant for carrying out said process.

A process for cooling sheets issuing from mills is known in particular which permits reaching high cooling rates for the purpose of treating thick sheets without however increasing the power consumed in a prohibitive manner. This process and the machine for carrying out the latter are described in the U.S. Pat. No. 3,885,581 filed by the Applicant. According to this process, at the end of the rolling, the heated sheet is presented horizontally at the entrance of a case in which it is driven with a uniform movement of translation by rolls. Simultaneously, a sheet of water of constant height driven at high speed circulates on the two sides of the sheet so as to dissipate the heat of the latter.

Thus, each surface element of the metal is in contact within the case with a regularly renewed mass of fluid. The corresponding thermal flux exchange between the sheet and the water increases with increase in the rate of flow of the water. With this process, it is possible to extract a thermal flux of the order of $3\times10^6$ W/m$^2$. This value corresponds to the core cooling of 30° C./sec. of a thick sheet of 30 mm. According to studies and experiments carried out by the Applicant, the cooling rates obtainable, according to the process described in the aforementioned patent application, appear to be quite compatible for producing, for example, the martensitic quenching of a manganese carbon steel sheet containing about 0.17% of carbon and ¼% of manganese, with no other alloy element. It will be obvious that the application of this same treatment to steels containing small amounts of additions, for example molybdenum, nickel or boron, the presence of which has for effect to increase the hardenability, would also produce a martensitic structure.

However, the process defined in said patent application does not permit a direct production of the desired final structure of a metal, for example of a steel of given composition. Indeed, the cooling operation usually involves the martensitic quenching of the metal and a tempering operation, characterized, in respect of steel, by the maintenance at a temperature lower than 710° C. for a suitable duration, must follow on the cooling operation. Now, studies relating to transformations upon cooling, show that the cooling rate determines the structure of a steel of given composition. Certain phases, in particular bainite, or mixtures of phases, very fine grain bainite or perlite, characterized by good mechanical properties of toughness and ductility, may be sought after in the case of suitable grades of steel.

Thus, to the extent to which it would be possible to control precisely the cooling rate of the sheet plates, the accelerated cooling at a chosen rate could be substituted for well-defined compositions of the metal for the quenching treatment and would permit the direct production of the desired metal structures without carrying out the additional tempering operation.

The invention has, consequently, an object to provide a cooling process and machine of the aforementioned type which permit regulating and controlling the cooling rate of the sheet plates according to given values as a function of the desired structures.

The invention therefore provides a process for controlling the cooling of a sheet for the purpose of imparting thereto a predetermined crystalline structure, wherein the sheet to be cooled is passed through a case containing a mass of regularly renewed cooling fluid and the flow of the cooling fluid is controlled as a function of the inlet temperature of said fluid, in accordance with the thickness of the sheet to be cooled and the desired cooling rate.

Another object of the invention is to provide a plant for carrying out the process defined hereinbefore, said plant comprising a machine including a case comprising means for circulating a cooling fluid which moves roughly in a direction parallel to the sheet, a cooling tank, means for injecting the cooling fluid contained in the tank inside said case, and means for discharging the cooling fluid after it has travelled in the cooling case, said plant further comprising means for controlling the flow of cooling fluid inside the case as a function of the temperature of the cooling fluid.

According to another feature of the invention, the plant comprises means for regulating the temperature of the cooling fluid introduced in the case.

According to a further feature of the invention, the plant comprises means for regulating the pressure of the fluid inside the case.

Further features and advantages of the invention will be apparent from the ensuing description with reference drawings, which are given solely by way of example and in which.

Figure 1:
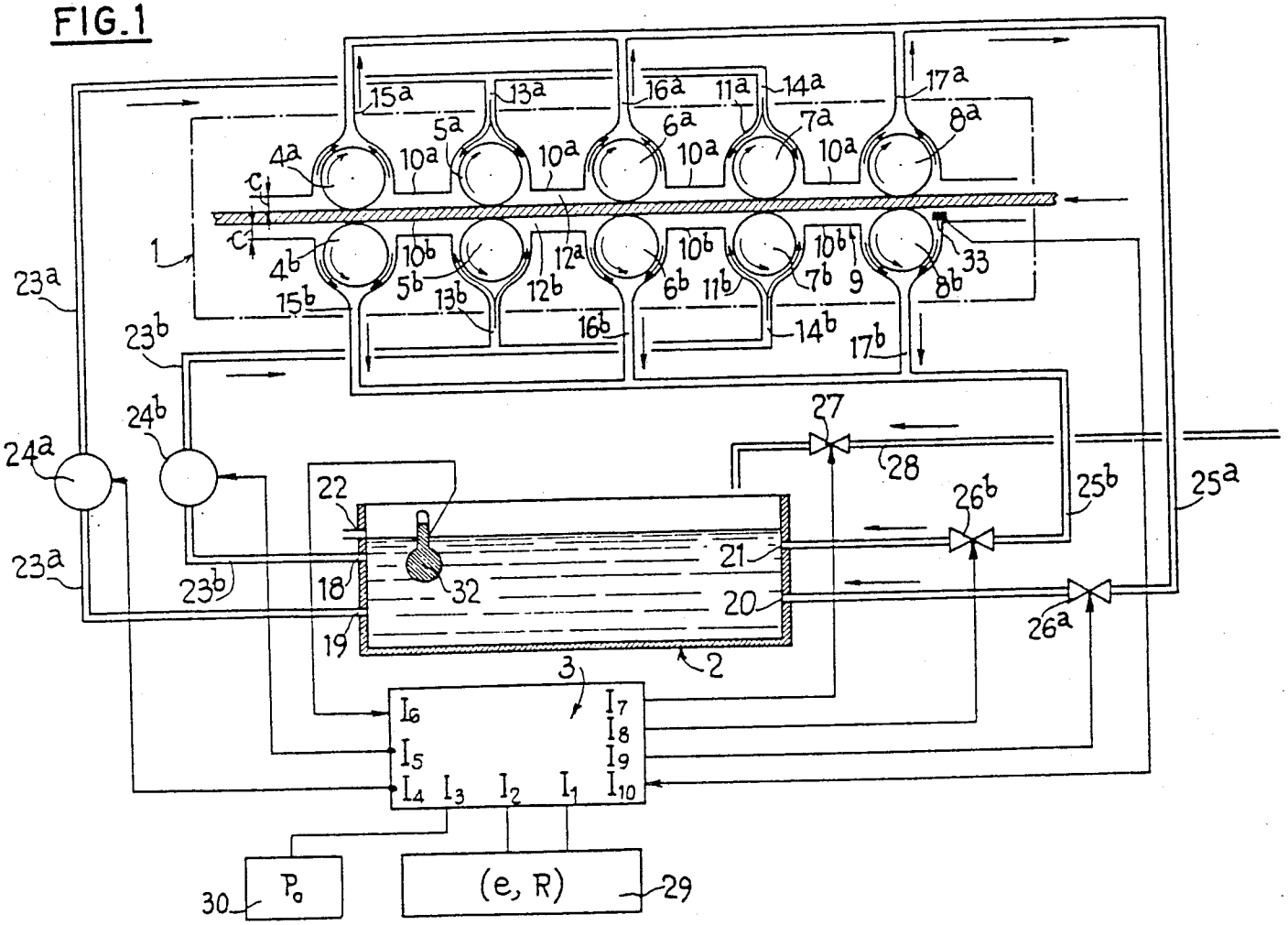
FIG. 1 shows a plant for carrying out the controlled cooling of sheets.

The plant shown in FIG. 1 comprises a cooling machine 1, a cooling tank 2, and a controlling and regulating device 3.

The cooling machine 1 is of the general type disclosed in said U.S. Pat. No. 3,885,581. This machine comprises a series of support and guide rolls 4*a*, 4*b* to 8*a*, 8*b*. Generally, the essential elements of the machine, disposed symmetrically on each side of the means plane of the sheet, will be designated by the same reference numerals to which is added an index a for the upper elements and an index b for the lower elements.

The machine comprises a metal housing or case 9 which extends between the guide rolls at 10*a*, 10*b*, and surrounds these rolls at 11*a*, 11*b*. The planar walls 10*a*, 10*b* are roughly parallel and are spaced apart by a gap which exceeds the thickness of the sheet so as to define with the latter two, chambers or passageways 12*a*, 12*b* having a thickness c. Water circulating means comprise at least one supply pipe 13*a*, 13*b*, 14*a*, 14*b*, extending for example throughout the length of the rolls 5*a*, 5*b*, 7*a*, 7*b*, and defining with the corresponding roll elongated narrow and continuous liquid outlet means extending continuously alongside each of the upper and lower surfaces of the sheet, and at least a discharge pipe 15*a*, 15*b*, 16*a*, 16*b*, 17*a*, 17*b* also extending throughout the length of the rolls 4*a*, 4*b*, 6*a*, 6*b* and 8*a*, 8*b*.

The cooling tank 2 contains the cooling water. Formed on its sides are orifices 18, 19 for the outlet of the cooling water toward the machine 1, and water inlet orifices 20, 21 for recovering the water which returns from the cooling machine.

It also includes in its upper part an overflow orifice 22.

The orifices 18 and 19 for the outlet of the water from the tank are connected to the supply pipes 13*a*, 13*b*, 14*a*, 14*b* of the machine by way of pipes 20*a*, 20*b* and supply pumps 24*a*, 24*b*. The water inlet orifices 20, 21 of the tank 2 are connected to the discharge pipes 15*a*, 15*b*, 16*a*, 16*b*, 17*a*, 17*b* through pipes 25*a*, 25*b* and electrically operated valves 26*a*, 26*b*. The electrically operated valve 27 mounted on the pipe 28 controls the supply of cold water to the tank.

The control and regulating device 3 mainly comprises a calculator which may be of the digital, analog or hybrid type, the latter type being adapted to effect the processing of both digital and analog magnitudes.

The illustrated control and regulating device 3 is of the hybrid type and it controls and regulates the flow through the pumps 24*a*, 24*b* and the electrically operated valves 26*a*, 26*b* and 27. It is connected by its inputs $I^1$, $I^2$ to a display panel 29 displaying set values, namely R relating to the desired cooling rate and e relating to the thickness of the sheet entering the cooling machine. The set values R and e are transmitted in accordance with a binary coded form to the inputs $I^1$ and $I^2$ of the device 3. The input $I^3$ is connected to a sensor 30 of the atmospheric pressure $P^o$. The outputs $I^4$ and $I^5$ transmit the command instructions to the pumps 24*a* and 24*b*. The input $I^6$ receives from a thermometric probe 32 disposed inside the tank 2 the value of the temperature of the cooling liquid. This temperature value is received in the form of an analog signal and in the form of a binary word of a plurality of bits. The outputs $I^7$ to $I^9$ ensure the respective controls of the electrically operated valves 27, 26*b* and 26*a*. The input $I^{10}$ receives the value of the pressure P relating to the water at the entrance of the case 9 of the machine and transmitted by a pressure sensor 33.

Figure 2:
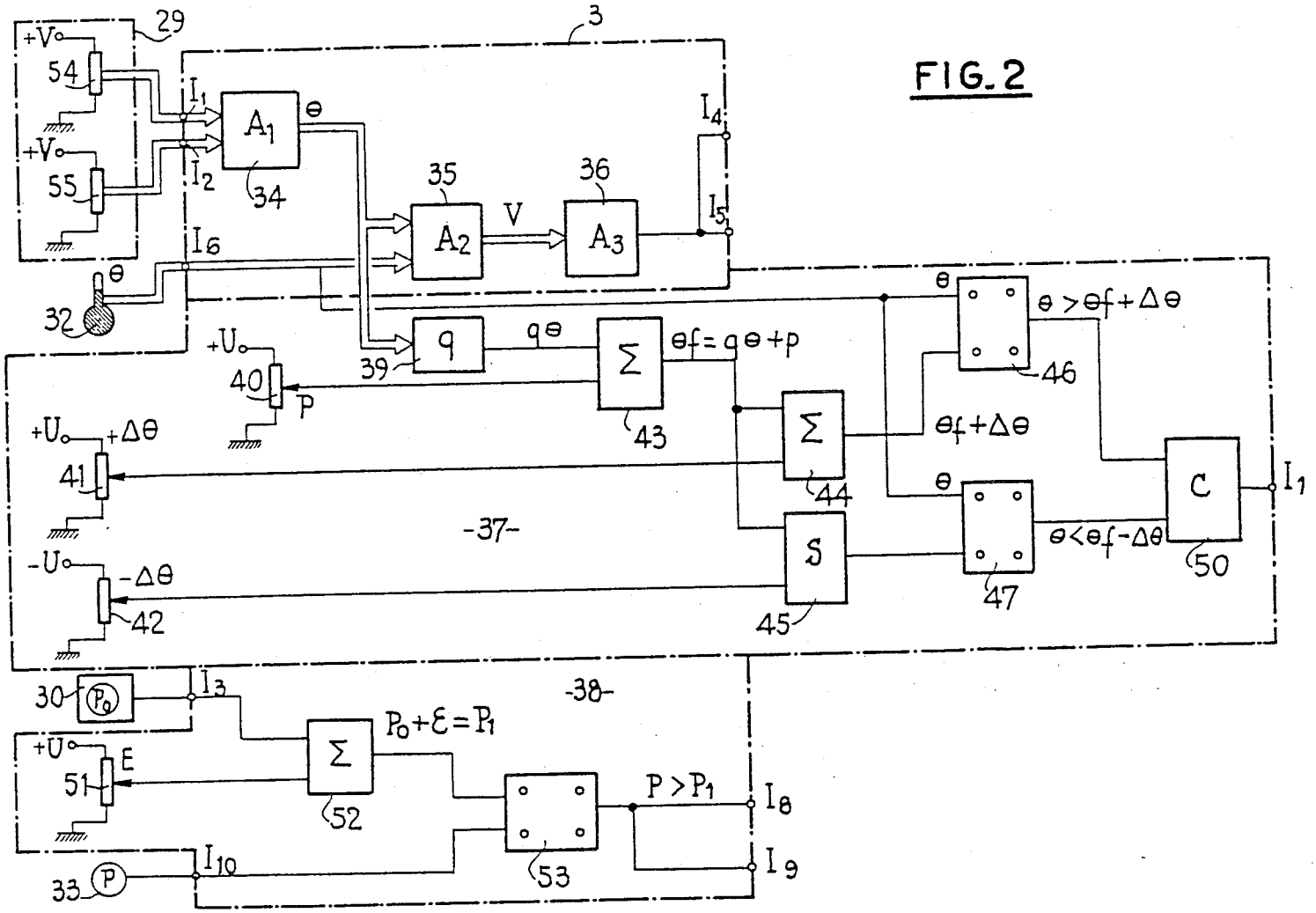
FIG. 2 shows an embodiment of the controlling and regulating means according to the invention.

The constructional details of the control and regulating device 3 are shown in FIG. 2. This device comprises means 34 for calculating the value of the thermal flux $\phi$ exchanged between the sheet T and the cooling water, means 35 for calculating the speed of the cooling fluid required for cooling the sheet under the desired conditions, means 36 for controlling the flow of the pumps 24*a* and 24*b*, means 37 for regulating the temperature of the water in the tank 2, and means 38 for regulating the pressure within the cooling case 9.

The means 34 comprises a programmable read-only memory which contains a table $A_1$ giving the values of thermal flux $\phi$ corresponding to set values R and e. This table $A_1$ may be determined from a theoretical calculation taking into consideration the thickness c of the sheet of cooling water circulating above and below the metal sheet to be cooled and the thermal conditions at the ends, in particular the heat flux exchange at the surface of the metal sheet. These calculations involve the equations of the heat and result in complicated formulae, and it is preferable to construct the table $A_1$ directly from tests carried out on several metal sheet thicknesses and in respect of different cooling rates.

The means 35 is also formed by a programmable read-only memory which contains a table $A_2$ giving the values of the cooling rates corresponding to the various values of thermal flux stored in the memory of the means 34 and to the various temperature values $\theta$ of the cooling water. This table $A_2$ is determined from the relation between the thermal flux $\phi$ exchanged and the speed of flow of the cooling water and is given by the formula :

$$\phi\ KW/\text{mm}^2 = \alpha(\theta)\frac{(V\ m/s)^{0.8}}{\sqrt{Lm}}\ (I) \text{ wherein}$$

$\alpha(\theta)$ is a coefficient which only depends on the temperature of the cooling water.

This formula was obtained from tests which establish a relationship between characteristic numbers of thermal exchange and flow.

The means 36 is also formed by a programmable read-only memory which contains in storage a table $A_3$ giving the values of the flow of the pumps as a function of the values of the speed of the cooling water read from the memory of the means 35.

This table may be easily constructed from the technical characteristics of the pumps. The means 36 also contains a digital-to-analog converter (not shown) connected to the output of its memory and which is necessary for delivering analog signals controlling the pumps 24*a* and 24*b*.

The memory of the means 34 is connected by its two addressing inputs to the inputs $I^1$ and $I^2$ of the device 3 and by its output, on one hand, to an addressing input of the memory of the means 35 and, on the other hand, to the input of a multiplication circuit 39 located in the regulating means 37. The memory of the means 35 is connected at its second addressing input to the input $I^6$ of the device 3 receiving the binary word constituted by the thermometric probe 32.

The output of the means 35 is connected to the addressing input of the memory of the means 36, and the output of the means 36 is connected to the outputs $I^4$ and $I^5$ of the calculator 3.

The regulating means 37 comprises a circuit for multiplying by a constant q, potentiometers 40, 41 and 42 respectively employed for introducing a constant p and ranges $+\Delta\theta$ and $-\Delta\theta$ of regulation of the temperature of the water contained in the tank 2. It also comprises adder circuits 43 and 44, a subtracter circuit 45, comparators 46 and 47 and means 50 for controlling the water supply electrically operated valve 27. The constants p and q are defined from the characteristics of the plant by the following formulae:

$$q = \frac{\theta_o - \theta_c}{\phi_M - \phi_m} \quad \text{(VI)}$$

and $$p = \frac{\theta_c\,\phi_M - \theta_o\,\phi_m}{\phi_M - \phi_m} \quad \text{(VII)}$$

wherein $\theta_o$ represents the minimum temperature of the industrial water employed as a cooling fluid;

$\theta_c$ is the critical value of the temperature of the cooling water corresponding to the steam pressure $p = p_o - u_1$;

$p_o$ is atmospheric pressure and $u_1$ the height or head of the siphons formed by the upper discharge pipes 15*a*, 16*a*, 17*a* of the machine.

During the cooling operation, the temperature of the cooling water must of course be between these two values $\phi_M$ and $\phi_m$ are determined from formula (I) for the respective values of $\theta_o$ and $\theta_c$ and for values V of the speed or rate of flow of the sheet of water corresponding thereto, bearing in mind that the speed V of the sheet of water must be higher than a critical speed $V_c$ so that the cooling fluid fills the case. This critical speed corresponds to a dynamic pressure expressed as a head or height of water equal to the thickness of the tunnel.

The circuit 39 for multiplying by a constant comprises, in the known manner, a digital-to-analog converter comprising a network of resistance cells (R, RR) arranged in $\pi$, the supply voltage of which is varied as a function of the value of the constant q.

The adder circuit 43 is connected by an input to the output of the circuit 39 and by its other input to the slide of the potentiometer 40.

The adder circuit 44 is connected by an input to the output of the circuit 43 and by its other input to the slide of the potentiometer 41. The subtracter circuit 45 is connected by an input to the output of the circuit 43 and by its other input to the slide of the potentiometer 42.

The comparator 46 has two inputs, one of which is connected to the input terminal $I^6$ of the device 3 for receiving the analog signal transmitted by the thermometric probe 32 whereas the other is connected to the output of the circuit 44. The comparator 47 also has two inputs, one of which is connected to the input terminal $I^6$ of the device 3 for receiving the analog signal transmitted by the thermometric probe 32 whereas the other is connected to the output of the circuit 45. The outputs of the comparators 46 and 47 are connected to two respective inputs of the means 50.

The regulating means 38 comprises a potentiometer 51, the adder circuit 52 and the comparator 53. The circuit 52 has two inputs, one of which is connected to the terminal $I^3$ of the device 3, whereas the other is connected to the slide of the potentiometer 51.

The comparator 53 also has two inputs, one of which is connected to the output of the circuit 52, whereas the other is connected to the input terminal $I^{10}$ of the device 3. The output of the comparator 53 is connected to the output terminals $I^8$ and $I^9$ of the device 3.

FIG. 2 also shows the devices for introducing the set values R and e of the display panel 29. These devices comprise analog-to-digital encoders 54 and 55, the parallel outputs of which are connected respectively to the input terminals $I^1$ and $I^2$ of the device 3. These encoders may comprise simple groups of switches the state of which represents for example the decimal value of the set value encoded in binary. FIG. 2 also shows the atmospheric pressure sensor 30 connected to the terminal $I^3$ of the device 3 and the pressure sensor 33 connected to the terminal $I^{10}$.

The cooling plant operates in the following manner:

The operator possesses the manufacturing data which are the thickness e of the sheet and the cooling rate R corresponding to the desired structures of the metal. These two data are set on the groups of switches 55 and 54 of the display panel 29. They are introduced at the input terminals $I^1$ and $I^2$ of the control and regulating device 3 in the direction of the addressing inputs of the memory of the means 34. These input magnitudes e and R address the contents of a zone of the memory of the calculating means 34 in which is to be found the corresponding magnitude $\phi$ of the theoretical thermal flux exchange between the plate of metal sheet and the cooling water in accordance with the relation $\phi = A^1$ (R,e).

The calculating means 35 determines the speed $V = A^2$ ($\phi$,$\theta$) of the sheet of water circulating on the plate of sheet metal as a function of the thermal flux previously calculated by the means 34 and of the temperature prevailing in the tank 2. This calculation is carried out by the addressing of the memory of the means 34 by the binary values $\phi$ and $\theta$ respectively transmitted by the means 34 and the thermometric probe 32.

When the speed V of the flow of the water in the pipes 12*a*, 12*b* is obtained by the means 35, the control means 36 acts on the flow of the pumps 24*a* and 24*b* so as to adjust the flow of the cooling water in the pipes 13*a*, 13*b*, 14*a* and 14*b*. As a result of the foregoing, the control and regulating device 3 controls the flow of the pumps in such manner as to achieve the desired cooling rate or speed as a function of the set data: e = thickness of the sheet, R = cooling rate and $\theta$ = temperature of the water contained in the tank 2.

The regulating device 37 regulates the temperature of the water in the tank 2. The operating temperature relating to the cooling water is determined by the adder circuit 43 and the circuit 39 multiplying by a constant. The circuit 39 delivers an output magnitude $q \cdot \phi$ which is proportional to the magnitude $\phi$ of the thermal flux exchanged between the sheet metal plate and the cooling water. This magnitude $q \cdot \phi$ is added to the aforementioned constant p introduced inside the calculating means 37 on the potentiometer 40. The output of the adder 43 therefore delivers a signal of amplitude $\theta f = q \cdot \phi + p$. The limits permitted in respect of the variation in the temperature $\theta f$ are set on the potentiometers 41 and 42, the potentiometer 41 delivering a value $+\Delta\theta$ and the potentiometer 42 delivering a value $-\Delta\theta$. The value $+\Delta\theta$ is added to the temperature of operation $\theta f$ in the adder circuit 44 which delivers at its output a value $\theta f + \Delta\theta$. This theoretical value $\theta f + \Delta\theta$ is compared with the temperature of the water measured in the tank 2 by the comparator 46 whose output controls the control means 50 of the electrically-controlled water supply valve 27 when the temperature $\theta$ of the measured water is higher than the calculated value $\theta f + \Delta\theta$. Similarly, the subtracter circuit 45 subtracts from the calculated value $\theta$ the value $-\Delta\theta$ of the measured water in the tank 2 by of the result $\theta f - \Delta\theta$ obtained is compared with the value $\theta$ of the measured water in the tank 2 by means of the comparator 47 so as to close the electrically operated valve 27 when the measured temperature of the water is lower than the calculated value $\theta f - \Delta\theta$. The regulating circuit 38 permits acting against pressure drops occurring in the return circuit which are due to the reduction in the flow of the injection of the cooling water by the pumps. The adder circuit 52 adds the value of the atmospheric pressure $P_o$ detected by the pressure sensor 30 to a value $\epsilon$ introduced in the potentiometer 51 and transmits the result of the addition $P_o + \epsilon$ to the input of the comparator 53 which compares this value with the pressure value P measured by the pressure sensor 33 inside the cooling case 9. When the pressure P appears to the comparator 53 to be higher than the pressure $P_o + \epsilon$, the comparator controls the opening of the return electrically operated valves 26*a*, 26*b*. On the other hand, if the pressure P is equal to or lower than the pressure $P_o + \epsilon$, the comparator 53 causes the closure of the return electrically operated valves 26*a* and 26*b* so as to increase the pressure P inside the cooling case.

The devices regulating the temperature and pressure just described afford the following advantages.

First of all, the device regulating the temperature maintains the water of the tank at a constant temperature, which permits, firstly, maintaining at a constant level the flux of heat exchange between the metal sheet and the cooling water and, secondly, maintaining at a constant level the pressure of the steam in the siphon formed by the discharge pipes 16*a*, 17*a*, and thus avoids the unpriming of the siphon and the flow of water through the ends of the machine.

Secondly, the presence of the electrically operated valves 26*a* and 26*b* in each of the discharge circuits, the opening of which is controlled by the flow of the supply pumps, permits avoiding the effects due to pressure drops in the machine. Their action in the return circuit, in maintaining the pressure within the case slightly higher than atmospheric pressure, precludes entry of air in the machine which would adversely affect its good operation.

The example of the manner of carrying out the invention just described was given in a hybrid analog-to-digital version of the control and regulating device 3. It will be clear that the same result could be obtained with a programmed digital calculator. In this case, it would be sufficient to store the set data e and R and the tables $A_1$, $A_2$ and $A_3$ in the memory of the calculator and calculate the theoretical values of the thermal flux $\phi$ and of the speed of flow V by carrying out corresponding programs.

It will also be observed that most of the operations described hereinbefore could also be achieved manually. In this case, the control of the pumps could be achieved by the reading of charts corresponding to the tables $A_1$, $A_2$ and $A_3$ described hereinbefore.

Having now described my invention what I claim as new and desire to secure by Letters Patent is:

1. An apparatus for cooling a metal sheet having a particular thickness e in accordance with a desired cooling rate R of said sheet for imparting to said sheet a selected crystalline structure, the apparatus being used in a cooling system which includes a closed case in which cooling liquid is placed in contact with the sheet, a tank containing said liquid, and pump means for circulating said liquid between said case and said tank, said apparatus comprising:

means for supplying a cooling liquid to an upper surface and to a lower surface of the sheet in a substantially horizontal position within said case by means of elongated narrow and continuous outlet means extending continuously in a given direction alongside each of said surfaces of the sheet throughout the extent of the sheet in said given direction so that said liquid is made to flow and spread across said surfaces in the lengthwise direction of the sheet in a continuous evenly-distributed sheet of liquid parallel to said surfaces, thereby preventing the spray of said liquid at angles to said surfaces which would disturb said flowing of said sheet of liquid across said surfaces, means for supplying said liquid to said case at a critical speed $V_C$ in such manner that the pressure of said liquid within said case is higher than atmospheric pressure and so that said liquid fills said case;

control means for receiving data representative of:

i. the thickness e of the particular metal sheet to be cooled;

ii. the desired cooling rate R of said sheet corresponding to the desired structures of the metal;

iii. the temperature of the cooling liquid in said tank;

said control means being provided for:

i. calculating the theoretical value of the thermal flux exchanged between said sheet and the cooling liquid based on said data representative of said thickness e and said desired cooling rate R in accordance with the relation $$\phi = A_1 (e, R)$$

wherein $\phi$ is the thermal flux calculated to be a function ($A_1$) of e and R:

ii. calculating the theoretical value of the velocity of the cooling liquid required for cooling the sheet under the desired cooling rate R and thickness e based on the calculated theoretical value of said thermal flux and the actual temperature $\phi$ of the cooling liquid in the tank in accordance with the relation $$V = A_2 (\phi, \theta)$$

wherein V is the velocity of the cooling liquid calculated to be a function of $\phi$ and $\theta$; and iii. calculating the theoretical temperature value of the cooling liquid based on the calculated value of the thermal flux;

means for variably controlling said pump means in accordance with the calculated value of said velocity of the cooling liquid and so that $V > V_C$; and means for regulating the actual temperature of the cooling in the tank based on the calculated theoretical temperature value.

2. An apparatus according to claim 1, further including a pressure sensor for indicating the pressure in the case to said control means, said control means causing the pressure in the case to alter when it varies from a particular value by altering the flow of cooling liquid between the case and the tank.

3. An apparatus according to claim 2, further including a pressure sensor for indicating atmospheric pressure to said control means, said control means causing the pressure in the case to increase when the pressure falls below a particular value, said value being dependent upon atmospheric pressure, by comparing the atmospheric pressure with the pressure in the case and restricting the flow of cooling liquid from the case to the tank.

4. An apparatus according to claim 1, said control means including a memory table relating values of thermal flux to values of cooling rate and thickness.

5. An apparatus according to claim 4, said control means including a memory table relating values of cooling rates to values of thermal flux.

6. An apparatus according to claim 1, said control means having a memory in which manufacturing data representing the thickness of the sheet and the cooling rate corresponding to the desired structures of the metal is stored; and including means for measuring the temperature in the case and providing an indication thereof to said control means, said control means calculating the theoretical thermal flux by means of a programmable read only memory as a function of said thickness and cooling rate, calculating the theoretical speed of the water circulating on the sheet by means of a programmable read-only memory as a function of said theoretical flux and the indication of temperature, adjusting the speed of cooling liquid based on said theoretical speed, comparing the indication of temperature with acceptable limits in the variation of temperature, and controlling the flow of cooling liquid to the case based on the results of the comparison of the temperature indication and the acceptable limits.

7. An apparatus according to claim 2, said control means having a memory in which manufacturing data representing the thickness of the sheet and the cooling rate corresponding to the desired structures of the metal is stored; and included means for measuring the temperature in the case and providing an indication thereof to said control means, said control means calculating the theoretical thermal flux by means of a programmable read only memory as a function of said thickness and cooling rate, calculating the theoretical speed of the water circulating on the sheet by means of a programmable read-only memory as a function of said theoretical flux and the indication of temperature, adjusting the speed of cooling liquid based on said theoretical speed, comparing the indication of temperature with acceptable limits in the variation of temperature, and controlling the flow of cooling liquid to the case based on the results of the comparison of the temperature indication and the acceptable limits.

8. An apparatus according to claim 1, wherein said control means calculates the thermal flux $\phi$ substantially independent from the temperature of the sheet.

* * * * *